US006680642B2

(12) United States Patent
Edell et al.

(10) Patent No.: US 6,680,642 B2
(45) Date of Patent: Jan. 20, 2004

(54) ANALOG BIPOLAR CURRENT SOURCE

(75) Inventors: David J. Edell, Lexington, MA (US); Sean V. Sexton, Georgetown, MA (US); Ying-Ping Liu, Bedford, MA (US)

(73) Assignee: Innersea Technology, Bedford, MA (US)

( * ) Notice: Subject to any disclaimer, the term of this patent is extended or adjusted under 35 U.S.C. 154(b) by 0 days.

(21) Appl. No.: 10/154,045

(22) Filed: May 23, 2002

(65) Prior Publication Data

US 2003/0218495 A1 Nov. 27, 2003

(51) Int. Cl.[7] ..... G05F 1/10; G05F 3/02
(52) U.S. Cl. ..... 327/538; 327/73; 323/312
(58) Field of Search ..... 327/72, 73, 100, 327/103, 538, 540, 541, 543; 330/69, 150; 323/312, 315, 316

(56) References Cited

U.S. PATENT DOCUMENTS 5,977,757 A * 11/1999 Felps ..... 323/282
6,031,219 A * 2/2000 Shuke ..... 250/214 R
6,094,092 A * 7/2000 Mizuno et al. ..... 327/546

* cited by examiner

*Primary Examiner*—Terry D. Cunningham
*Assistant Examiner*—Quan Tra
(74) *Attorney, Agent, or Firm*—Weingarten, Schurgin, Gagnebin & Lebovici LLP

(57) ABSTRACT

A precision current source is disclosed that includes a voltage setting circuit that precisely sets the voltage across a range setting resistor to set the current flowing in a load resistance connected in series with the range setting resistor. The voltage setting circuit precisely sets the voltage across the range setting resistor as a function of an input reference voltage. The voltage setting circuit includes an instrumentation amplifier that determines the voltage across the range setting resistor and the difference between this voltage and the reference voltage is used drive a drive voltage amplifier. The drive voltage amplifier output adjusts to minimize the difference between the reference voltage and the voltage across the range setting resistor. Other embodiments include the use of a DC blocking capacitor to allow only AC coupling and various nulling. circuits to remove any charge buildup on a DC blocking capacitor.

14 Claims, 5 Drawing Sheets

ANALOG BIPOLAR CURRENT SOURCE

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

A current source that provides a varying output current in response to an analog input voltage should be able to reproduce a high fidelity current representation of that analog voltage signal. Prior art current sources that could provide a high fidelity current signal however, have had several problems. The prior art current sources typically have had a low output impedance, high cross-over distortion, low bandwidth, and phase and amplitude distortion. Although some prior art circuits could overcome some, but not all of these problems, these prior art current sources typically used power supplies that needed to be electrically isolated and have a low coupling capacitance to allow connection to the feedback node as an output. In addition, some current sources that are used in physiological and neural investigations must remove DC current from the electrodes. DC current can result in error in potential measurements, corrosion of the electrodes or damage to the biological tissue.

Therefore, what is needed in the art is a current source that provides a high fidelity current representation of an analog input voltage and that has a high output impedance, low crossover distortion, high bandwidth, low phase and amplitude distortion, and that prevents DC current from the output.

BRIEF SUMMARY OF THE INVENTION

Other forms, features, and aspects of the above-described methods and system are described in the detailed description that follows.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Referring to the figures, FIGS. 1–5 depict embodiments of a precision current source that provide a precise level of current to a load that is a high fidelity representation of an analog reference voltage. The current source described herein is a linear high bandwidth current source with little waveform distortion and substantially no crossover distortion. In addition, current representations of sine waves, triangle waves, exponential waves, square waves, and symmetric and asymmetric biphasic rectangular waves can be generated with little or no phase and amplitude distortion.

Figure 1:
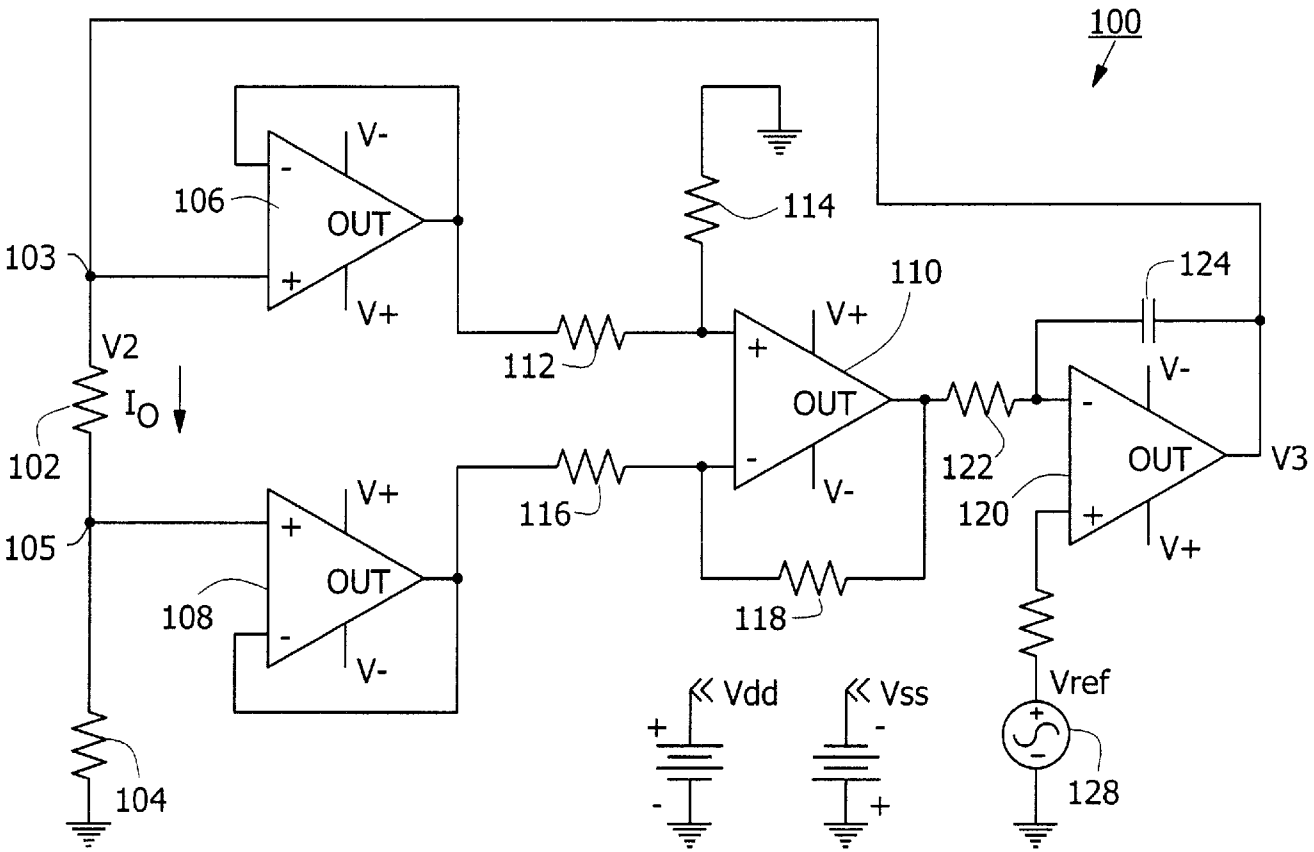
FIG. 1 is a circuit schematic of a first embodiment of the presently described current source.

As depicted in FIG. 1, the precision current source 100 precisely sets a voltage V2 across the range setting resistor 102 to set the level of current $I_0$ that is provided to the load resistor 104. The current $I_0$ flowing through the range setting resistor 102, and subsequently through the load 104, is equal to $I_0$=V2/R1, where R1 is the resistance of resistor 102. In order to set and maintain the precision voltage V2 across resistor 102, an instrumentation amplifier is used that includes three op-amps and assorted resistors and capacitors that provide the voltage across the range setting resistor 102 to a fourth op-amp that sets the drive voltage on the output resistor to hold the output of the instrumentation amplifier circuit nearly equal to the set voltage.

In particular, the instrumentation amplifier includes a non-inverting op-amp follower circuit 106 that is coupled to the high side node 103 of resistor 102 and provides a buffered output equal to the voltage at node 103. A second non-inverting op-amp follower circuit 108 is coupled to the low side of resistor 102 at node 105 and provides a buffered output equal to the voltage at node 105. These two voltages are provided to a difference circuit consisting of op amp 110 and resistor 112, 114, 116, and 118. The two voltages are subtracted from one another, with the difference between the two voltages equal to V2, the voltage across resistor 102.

The output of the difference circuit, i.e., the output of the instrumentation amplifier, is provided to a voltage drive circuit that precisely sets the voltage across the range setting resistor 102. The drive voltage circuit includes op-amp 120, resistor 122 and capacitor 124. The output of the difference circuit is coupled to one input of op-amp 120. The other input of op-amp 120 is coupled to the voltage reference 128. In the event that the voltage V2 is not equal to the voltage signal provided by voltage reference 128, the op amp 120 and associated components rapidly adjust the op-amp output voltage, V3, to reduce the difference between the sensed voltage V2 and the reference voltage 128. It can be shown that the closed loop dynamics of the precision current source depicted in FIG. 1 form a proportional-integral control loop and the dynamics are given by:

$$\frac{I_0}{V_{ref}} = \frac{\frac{1}{R1}}{\left(s + \left(\frac{R1}{R1 + R2}\right)\right)} \tag{1}$$

where R1 is the range setting resistor 102, R2 is the load resistance 104, and $V_{ref}$ is the voltage reference 128. As can be seen from equation (1), the system is stable and will respond exponentially to changes in $V_{ref}$. Changes in either $V_{ref}$ or changes in the load resistance 104 disturb the steady state voltage V2 and the steady state current value $I_0$. This change in V2 is sensed by voltage driver circuit. The voltage driver circuit that includes op-amp 120 and the associated components adjusts the output of op-amp 120, V3, by substantially the same amount as the voltage change across the range setting resistor 102. By adjusting V3 in this manner, the voltage V2 across the resistor 102 accurately tracks the output voltage of voltage reference 128. Therefore, the magnitude of the specified reference voltage 128 always appears across the range setting resistor 102 regardless of load conditions. It can be seen in equation (1) that the voltage V2 will track the reference voltage 128 with only a minor lag time due to the exponential nature of the control loop.

The output impedance of any current source should be as high as possible to ensure proper current source operation. The output impedance of the precision current source 100 at a specific frequency is equal to the product of the open loop gain of op amp 120 at that frequency multiplied by the value of the range setting resistor 102. Thus, for low current ranges where resistor 102 can have a value greater than 10K Ohms, the output impedance at low frequency is greater than 100M Ohms using typical high-performance op amps. If higher current ranges are used, the range setting resistor 102 will have a lower resistance value; however, the output impedance at low frequency is still large, approximately 1M Ohms. At higher frequencies, the output impedance will drop off due to parasitic capacitances at the output node and due to the falloff of the op-amp open loop gain at higher frequencies.

Any errors in the specified current flowing through resistor 102 are caused by the offset voltages of the op amps and the small differential voltage that is necessary to adjust the outputs appropriately. It is therefore preferable in the embodiment depicted in FIG. 1 to use high performance op-amps in order to reduce the offset errors as much as possible. The op-amps used in the current source described herein should have an input bias current that is very small compared to the anticipated output current. Preferably, the input bias current is 100 times or smaller than the anticipated output current to avoid any magnitude error. In addition, the higher the frequency response of the op amps used, the higher the frequency response of the current source will be. Also, the higher the slew rate of the op-amps, the better the amplifier can track large changes to the external impedances and large, sudden changes in the specified current. The op-amps should also be relatively low noise since any amplifier noise will be directly coupled back to the output control voltage and hence will cause output noise currents.

As discussed above, in neurological and physiological investigations AC coupling to the load is desirable. In these embodiments, a DC blocking capacitor, capacitor 202 in FIGS. 2–5, is used to block the DC current from the load resistance. However, the precision current source depicted in FIG. 1 has a small DC error voltage across the range setting resistor 102 that results in a charge buildup on the DC blocking capacitor 202. The charge build up on the DC blocking capacitor 202 will affect the compliance voltage of the current source and can lead to a distortion of the output current waveform.

Figure 2:
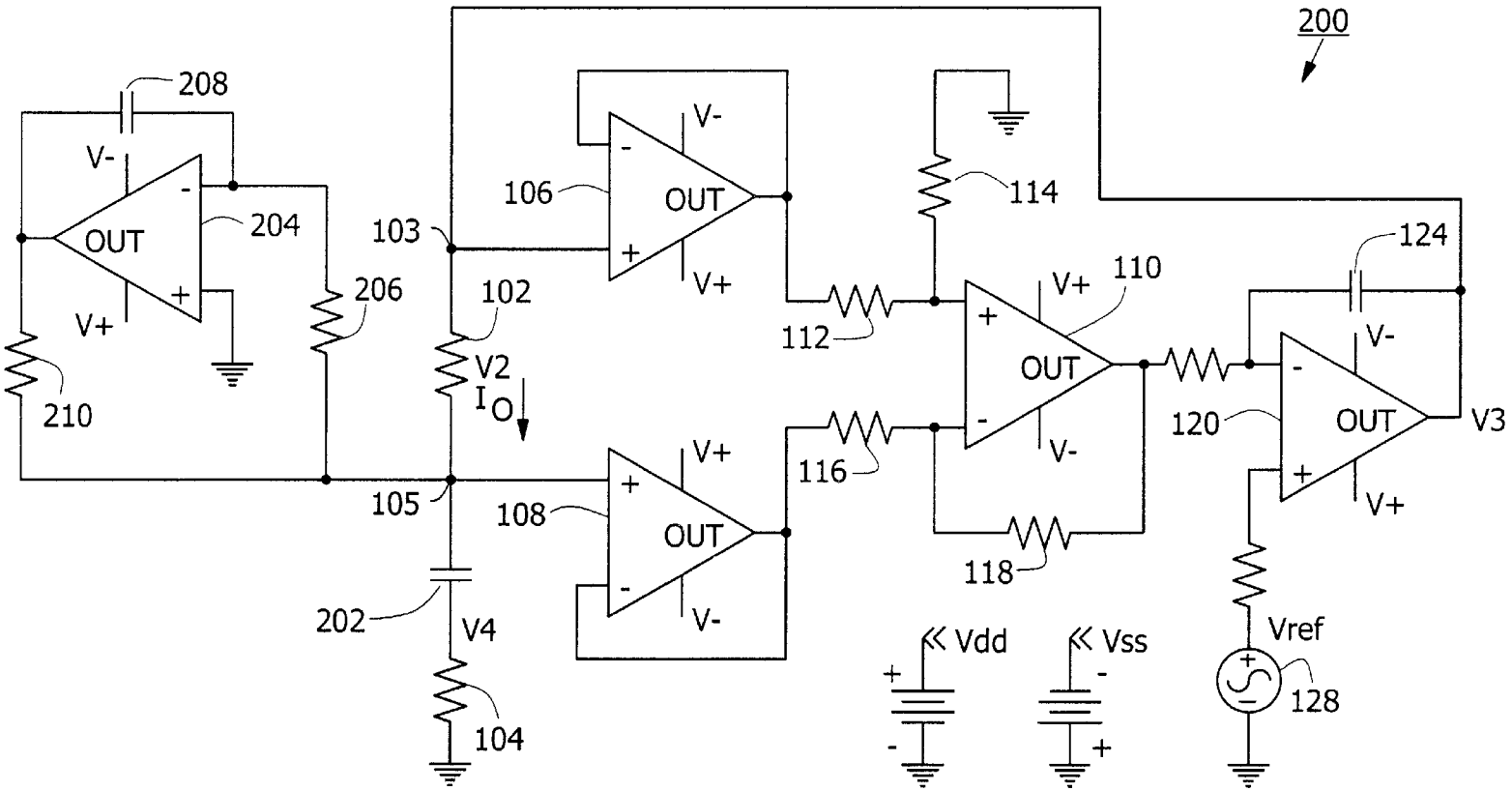
FIG. 2 is a circuit schematic of a second embodiment of the presently described current source.

FIG. 2 depicts another embodiment of the precision current source that includes a charge nulling circuit that continuously subtracts the DC charge buildup from the DC blocking capacitor 202. In particular, FIG. 2 depicts the precision current source of FIG. 1 that further includes the DC blocking capacitor 202 and a nulling circuit consisting of op amp 204, resistors 206 and 210, and capacitor 208. Resistor 206 and capacitor 208 together form a low pass filter that is used to sense and filter the DC offset at node 105. This offset value is compared to zero volts using op amp 204, the output of which provides a current via resistor 210 that reduces the voltage at node 105 to very close to zero, i.e., ground. In response to a disturbance in the output load resistor 104 or a change in the voltage signal provided by the voltage reference 128, op amp 204 senses the change in voltage at node 105 and provides sufficient current through resistor 210 to return the voltage at node 105 to within a few millivolts of zero. Thus, when the voltage at node 103 and node 105 are subtracted, the voltage at node 103 is equal to V2 and the voltage at node 105 equals zero. As discussed above, the op-amp 120 and its associated components provide an output to ensure that the sensed voltage, voltage V2, accurately tracks the reference voltage 128. The upper limit of the DC error offset voltage is dependent on the maximum current capacity of the op amp 204, which is dependent upon the maximum output voltage of op amp 204 and the resistance of resistor 210. Resistor 206 can be set quite large in order to provide a low cutoff frequency; however, resistor 210 must be small enough to allow sufficient current to flow to/from node 105 to provide a voltage at node 105 that will return the potential at node 105 to substantially zero volts. Accordingly, the output impedance of the precision current source is limited by resistor 210.

Figure 3:
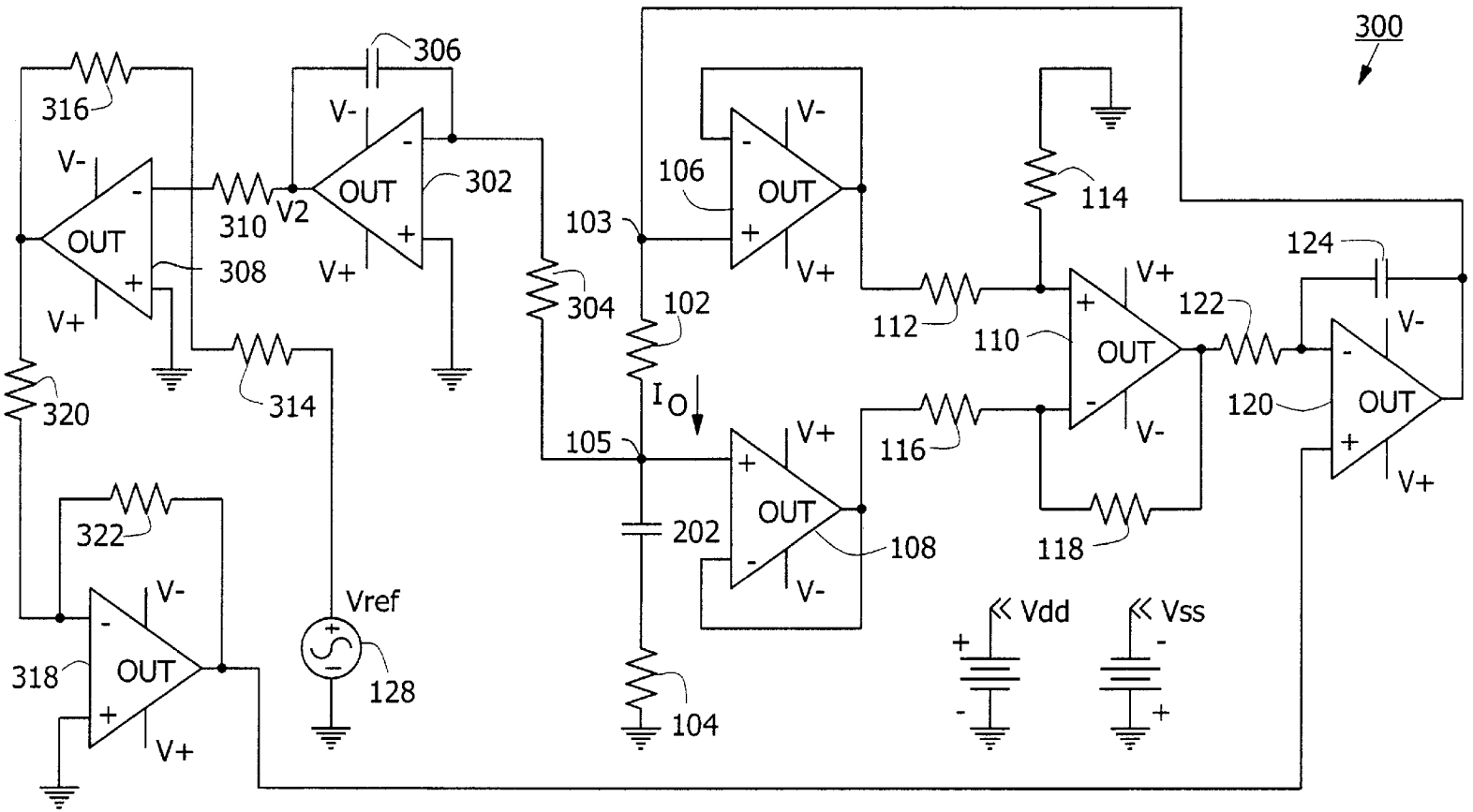
FIG. 3 is a circuit schematic of a third embodiment of the presently described current source.

FIG. 3 depicts an embodiment of the precision current source of FIG. 1 that provides nulling of the DC voltage without compromising the high output impedance that is required of a current source. In particular, FIG. 3 depicts the voltage at node 105 being sensed by op amp 302 and the associated components, resistor 304 and capacitor 306. The output of op-amp 302 is the integral of the offset voltage sensed at node 105. This integrated voltage is summed with the voltage reference 128 by an adder circuit including op-amp 308 and resistors 310, 314, and 316. The sum of the sensed null voltage from node 105 and the control voltage 128 is provided to the input of op amp 120 via the buffer amplifier op amp 318 and resistors 320 and 322. The operation of the remainder of the circuit is described above with respect to FIG. 1.

Figure 4:
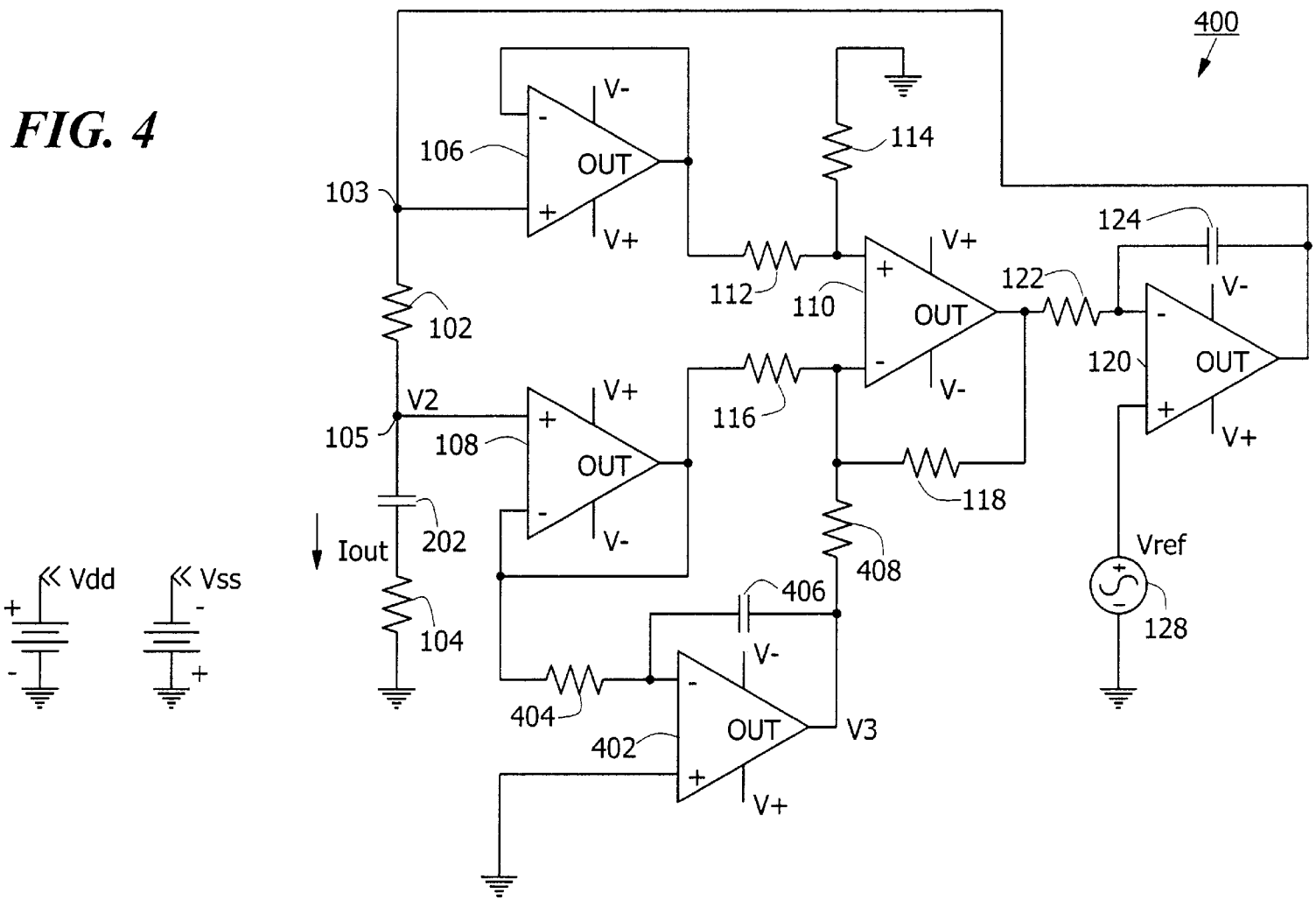
FIG. 4 is a circuit schematic of a fourth embodiment of the presently described current source.

The circuit depicted in FIG. 3 requires an additional three op amps, six resistors, and one capacitor. Reducing the number of components in the nulling circuit, without compromising the output impedance of the current source, would result in a substantial savings both in terms of the cost of producing the circuit and in the power consumed by the circuit. FIG. 4 depicts a precision current source that includes a nulling circuit that consists of a single op amp 402, a pair of resistors 404 and 408, and a single capacitor 406. The DC offset voltage at node 105 is detected by the op amp 402 through a low pass filter of resistor 404 and capacitor 406. The nulling voltage generated by op amp 402 is combined at the difference circuit, op amp 110 and resistor 112, 114, 116, and 118, to add or subtract the nulling voltage along with voltage sensed from node 105. The rest of the circuit operates as described above with respect to FIG. 1. In this embodiment, the nulling is accomplished with a single additional op amp and there are no direct connections to the sensitive output node. In this way, the bandwidth and the output impedance of the precision current source are not affected by the addition of the nulling circuit.

Figure 5:
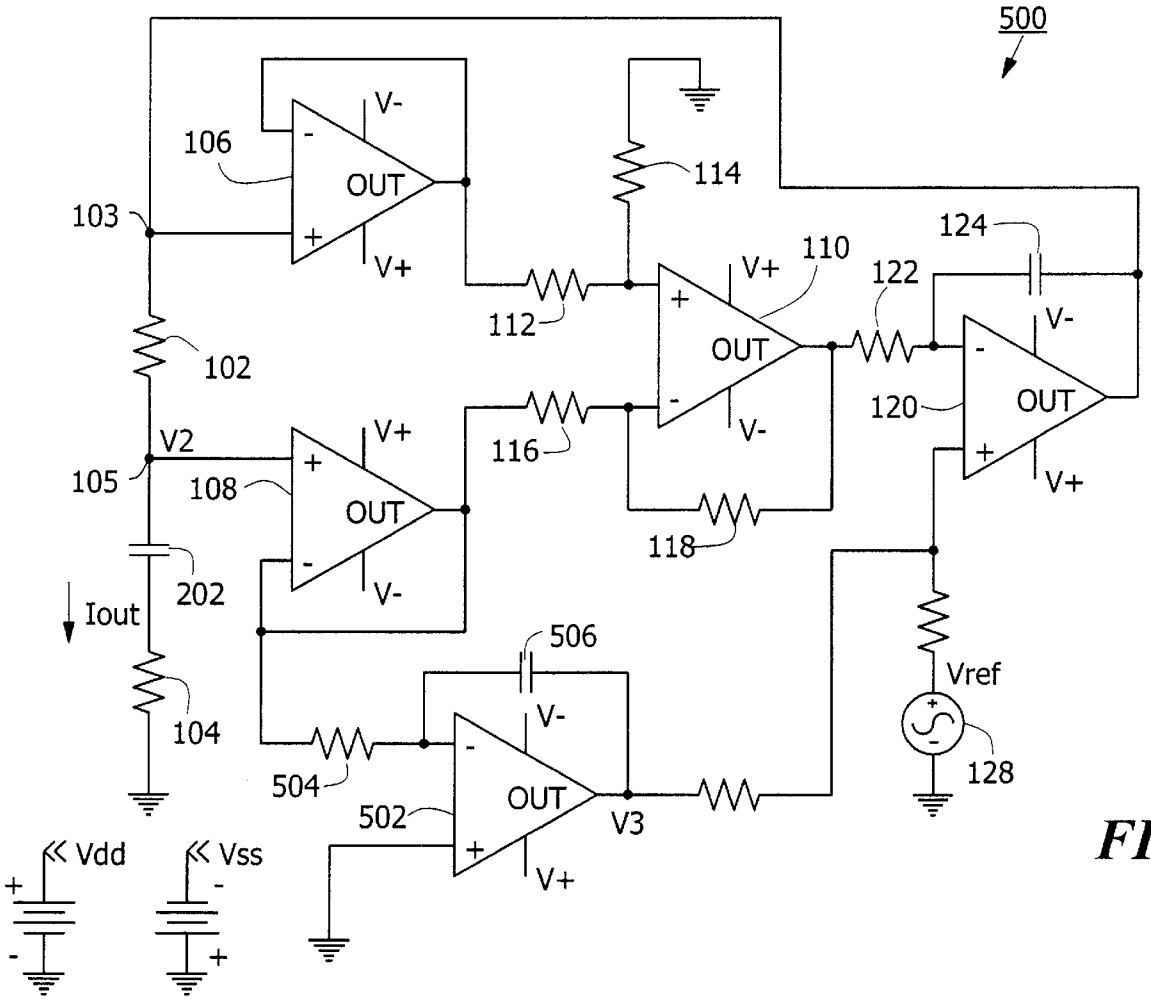
FIG. 5 is a circuit schematic of a fifth embodiment of the presently described current source.

The circuit in FIG. 4, although reducing the component count and maintaining the bandwidth and output impedance of the precision current source, nonetheless includes a subtle amplitude error due to the parasitic resistor added to the summing node of op-amp 110. FIG. 5 depicts an embodiment of the precision current source in which the offset voltage is sensed by op amp 502, resistors 504, and capacitor 506. Resistor 504 and capacitor 506 form a low pass filter that senses the DC offset voltage and op-amp 502 provides a nulling voltage that is added or subtracted at the non-inverting input of op amp 120 with the voltage reference 128. In this embodiment, the summing node of the instrumentation amplifier is not compromised and the output impedance and bandwidth of the precision current source are maintained.

The precision current source described herein can also be used for transmitting analog or digital data without significant noise corruption. In this communications application of the precision current source, resistor 102 would be located at a remote location at the end of a transmission cable, wherein the signal would be acquired by the instrumentation amplifier across the remote resistor. Alternatively, by substituting a photodiode for resistor 102 a suitable photo detector to acquire the light emitted by the photo diode an optical signal may be transmitted as well. Alternatively, a high frequency transformer could be used to transfer the signal by inputting the current through one side of the transformer and sensing it with a current to voltage converter on the other.

Another use of this precision current source is for generating precision DC micro, nano, and pico ampere currents that are useful for testing integrated circuits. The output of the precision current source would typically be connected directly to a current drive node of a low power integrated circuit and used to adjust the operating point of the circuit while under test.

In another application the precision current source described herein could be used as the operation of remote speakers wherein using four wires the current through the speaker winding could be precisely set by the precision current circuit described herein without regard to the ohmic losses in the cabling or of the electrical noise that may be coupled into the cabling from extraneous sources.

What is claimed is:

1. A precision current source comprising:

a range setting resistor having a high side which has a high side voltage and a low side which has a low side voltage;

an output load resistance connected in series between the low side of the range setting resistor and ground;

an instrumentation amplifier having a first input coupled to the high side of the range setting resistor and sensing the high side voltage and a second input coupled to the low side of the range setting resistor and sensing the low side voltage, the instrumentation amplifier providing an output that is a function of the difference between the high side voltage and the low side voltage;

a voltage reference source;

a drive voltage amplifier having a first input coupled to the output of the instrumentation amplifier and a second input coupled to the voltage reference source, the drive voltage amplifier operative to provide an output voltage that is a function of the difference between the first input and the second input, the output voltage of the drive voltage amplifier being coupled to the high side of the range setting resistor, wherein the output voltage of the drive amplifier is adjusted to maintain a voltage equal to the magnitude of the voltage reference source across the range setting resistor.

2. The precision current source of claim 1 wherein the instrumentation amplifier includes:

a first sense amplifier coupled to the high side of the range setting resistor, the first sense amplifier operative to provide an output signal indicative of the high side voltage;

a second sense amplifier coupled to the low side of the range setting resistor, the second sense amplifier operative to provide an output signal indicative of the low side voltage;

a difference module having first and second inputs, the first input coupled to the output signal of the first sense amplifier, the second input coupled to the output signal of the second sense amplifier, the difference amplifier operative to provide an output signal indicative of the difference between the output signal of the first sense amplifier and the output signal of the second amplifier.

3. The current source of claim 2 wherein the first sense amplifier includes an op-ramp configured as a voltage follower.

4. The current source of claim 2 wherein the second sense amplifier includes an op-amp configured as a voltage follower.

5. The current source of claim 2 wherein the difference module includes an op-amp having non-inverting and inverting inputs and an output, a first resistor having a first end coupled to the output signal of the first sense amplifier and a second end coupled to the non-inverting input, a second resistor having a first end coupled to the output signal of the second sense amplifier and a second end coupled to the inverting input, a third resistor connected in series between the non-inverting input and ground, a fourth resistor connected in series between the output and the inverting input.

6. The current source of claim 1 wherein the drive voltage amplifier includes an op-amp having a non-inverting and inverting input and an output, wherein the first input is the inverting input and the second input is the non-inverting input, and further including a first resistor connected between the output signal of the difference module and the inverting input, a capacitor connected in series between the output and the inverting input, and a second resistor connected in series between the voltage reference source and the non-inverting input, the output of the op-amp being coupled to the high side of the range setting resistor.

7. The current source of claim 1 further including an offset nulling circuit having an input coupled to the low side of the range setting resistor and providing an output nulling signal, the output nulling signal is provided to the low side of the range setting resistor and wherein the low side of the range setting resistor is set to substantially zero volts.

8. The current source of claim 7 wherein the offset nulling circuit includes an op-amp having an output, a non-inverting input and an inverting input, a first resistor connected in series between the low side of the range setting resistor and the inverting input of the op-amp, a capacitor connected in series between the output of the op-amp and the inverting input, and a second resistor connected in series between the output and the low side of the range setting resistor.

9. The current source of claim 1 further including an offset nulling circuit having an input coupled to the low side of the range setting resistor and providing an output signal that is the composite of the nulling signal and the voltage reference source, the composite signal is provided to the second input of the drive voltage amplifier, wherein the low side of the range setting resistor is set to substantially zero volts.

10. The current source of claim 9 wherein the offset nulling circuit includes:

a first op-amp having an output, a non-inverting input and an inverting input, a first resistor connected in series between the low side of the range setting resistor and the inverting input of the op-amp, a capacitor connected in series between the output of the op-amp and the inverting input;

a second op-amp having an output, a non-inverting input and an inverting input, a second resistor connected in series between the output of the first op-amp and the inverting input of the op-amp, a third resistor connected in series between the voltage reference source and the inverting input of the second op-amp, a fourth resistor connected in series between the output of the second op-amp and the inverting input of the second op-amp;

a third op-amp having an output, a non-inverting input and an inverting input, a fifth resistor connected in series between the output of the second op-amp and the inverting input of the third op-amp, a sixth resistor connected in series between the output of the third op-amp and the inverting input of the third op-amp, the output of the third op-amp being coupled to the second input of the drive voltage amplifier.

11. The current source of claim 1 further including an offset nulling circuit having an input coupled to the output of the second sense amplifier and providing an output nulling signal to the second input of the difference module, wherein the nulling signal is removed from the difference output signal so that the low side of the range setting resistor is reduced to substantially zero volts.

12. The current source of claim 11 wherein an the nulling circuit includes:

an op-amp having an output, a non-inverting input and an inverting input, a first resistor connected in series between the output signal of the second sense amplifier and the inverting input of the op-amp, a capacitor connected in series between the output of the op-amp and the inverting input, and a second resistor connected in series between the output and the second input of the difference module.

13. The current source of claim 12 further including an offset nulling circuit having an input coupled to the output of the second sense amplifier and providing an output nulling signal to the second input of the drive voltage amplifier, wherein the nulling signal is combined with the voltage reference source so that the low side of the range setting resistor is reduced to substantially zero volts.

14. The current source of claim 13 wherein an the nulling circuit includes:

an op-amp having an output, a non-inverting input and an inverting input, a first resistor connected in series between the output signal of the second sense amplifier and the inverting input of the op-amp, a capacitor connected in series between the output of the op-amp and the inverting input, and a second resistor connected in series between the output and the second input of the drive voltage amplifier.

* * * * *

UNITED STATES PATENT AND TRADEMARK OFFICE

CERTIFICATE OF CORRECTION

PATENT NO. : 6,680,642 B2
DATED : January 20, 2004
INVENTOR(S) : David J. Edell et al.

It is certified that error appears in the above-identified patent and that said Letters Patent is hereby corrected as shown below:

Column 6,
Line 7, “op-ramp” should read -- op-amp --.

Signed and Sealed this

Ninth Day of November, 2004

JON W. DUDAS
*Director of the United States Patent and Trademark Office*